US010985443B2

(12) United States Patent
Lin et al.

(10) Patent No.: US 10,985,443 B2
(45) Date of Patent: Apr. 20, 2021

(54) ANTENNA PACKAGING STRUCTURE

(71) Applicant: KAIKUTEK INC., Taipei (TW)

(72) Inventors: Yi-Cheng Lin, Taipei (TW); Mike Chun-Hung Wang, Taipei (TW); He-Sheng Lin, Taoyuan (TW)

(73) Assignee: Kaikutek Inc., Taipei (TW)

( * ) Notice: Subject to any disclaimer, the term of this patent is extended or adjusted under 35 U.S.C. 154(b) by 0 days.

(21) Appl. No.: 16/526,100

(22) Filed: Jul. 30, 2019

(65) Prior Publication Data

US 2021/0036403 A1 Feb. 4, 2021

(51) Int. Cl.

*H01Q 1/22* (2006.01)
*H01Q 1/48* (2006.01)
*H01Q 9/04* (2006.01)

(52) U.S. Cl.

CPC ..... *H01Q 1/2283* (2013.01); *H01Q 1/48* (2013.01); *H01Q 9/0407* (2013.01)

(58) Field of Classification Search

CPC ..... H01L 2224/16225; H01L 2224/131; H01L 2224/32225; H01L 2224/73204; H01L 2924/00014; H01L 2924/00; H01L 2924/014; H01L 2924/00012; H01L 2223/6677; H01L 2224/73253; H01L 24/16; H01L 2224/16227; H01L 2224/17517; H01L 2224/32013; H01L 2224/32014; H01L 2224/33181; H01L 24/13; H01L 24/17; H01L 24/32; H01L 24/33; H01L 2924/15192; H01L 2924/15321; H01L 2924/15322; H01L 2924/3025; H01L 2224/48091; H01L 2224/05599; H01L 2224/45015; H01L 2224/45099; H01L 23/66; H01L 2924/09701; H01L 2924/207; H01L 2224/291; H01L 2224/83815; H01L 2924/12042; H01L 2223/6616; H01L 2223/6627; H01L 2223/6633; H01L 2224/16235; H01L 2224/48227; H01L 2224/48235; H01L 23/04; H01L 24/48; H01L 2924/01079; H01L 2924/14; H01L 2924/15153; H01L 2924/1517; H01L 2924/1903; H01L 2924/19039; H01L 2224/26175; H01L 2224/3015;

(Continued)

(56) References Cited

U.S. PATENT DOCUMENTS

2010/0327068 A1* 12/2010 Chen ..... H01L 23/66 235/492

* cited by examiner

*Primary Examiner* — Monica C King

(74) *Attorney, Agent, or Firm* — Rosenberg, Klein & Lee

(57) ABSTRACT

An antenna packaging structure includes a top substrate, an antenna chip, a bottom substrate, and a plurality of antenna transmission lines. The top substrate includes an antenna. The bottom substrate includes a circuit. The antenna chip is mounted on the bottom substrate, and is electrically connected to the antenna of the top substrate through the circuit of the bottom substrate and the antenna transmission lines. Since the antenna chip is directly electrically connected to a processor through the circuit, a plurality of communication lines do not need to be electrically connected between the antenna and the circuit. Further, since the antenna transmission lines just need to transmit a simple antenna signal between the antenna and the antenna chip, an amount of the antenna transmission lines is smaller than an amount of communication lines. Moreover, the total size of the antenna packaging structure is reduced.

9 Claims, 4 Drawing Sheets

(58) Field of Classification Search
CPC . H01L 2224/32227; H01L 2224/83191; H01L 24/26; H01L 24/83; H05K 1/111; H05K 1/181; H05K 2201/10674; H05K 2201/10787; H05K 2201/10984; H05K 2203/0465; H05K 2203/1173; H05K 3/321; H05K 3/34; H05K 3/341; H05K 3/4007
See application file for complete search history.

ANTENNA PACKAGING STRUCTURE

BACKGROUND OF THE INVENTION

1. Field of the Invention

The present invention relates to a packaging structure, and more particularly to an antenna packaging structure.

2. Description of the Related Art

An electronic device usually includes a wireless communicating function. Therefore, the electronic device may include an antenna module for supporting the wireless communicating function.

The antenna module includes an antenna, an antenna integrated circuit (IC), and an antenna processor. The antenna IC may be mounted on the antenna to control the antenna for transmitting or receiving wireless signals. The antenna needs to be mounted on a printed circuit board (PCB) to electrically connect to the antenna processor. Therefore, the antenna processor can communicate with the antenna IC to perform the wireless communicating function. For example, the antenna IC may be an antenna transceiver, such as a Radio Frequency Integrated Circuit (RFIC), and the antenna processor may be a digital processor.

Since the antenna processor needs to communicate with the antenna IC, the antenna may be electrically connected to the PCB through a plurality of communication lines to transmit communication signals. Therefore, the antenna processor can be electrically connected to the antenna IC through the PCB, the communication lines, and the antenna.

Further, since the antenna is electrically connected to the PCB through the communication lines, the antenna and the PCB each need to include one respective connecting area to connect the communication lines. Therefore, a size of the antenna correspond to an amount of the communication lines. The more the amount of the communication lines is, the larger the size of the antenna is. For the same reason, the more the amount of the communication line is, the larger a size of the PCB is.

However, since the wireless communicating function of the electronic device becomes more complicated, the amount of the communication lines is increased. A total size of the antenna module cannot be reduced since the communication lines increase. Therefore, the antenna module needs to be further improved.

SUMMARY OF THE INVENTION

An objective of the present invention is to provide an antenna packaging structure. The present invention can reduce a total size of the antenna packaging structure. The antenna packaging structure includes a top substrate, an antenna chip, a bottom substrate, and a plurality of antenna transmission lines.

The top substrate includes an antenna. The bottom substrate includes a circuit, and is under the top substrate.

The antenna chip is mounted on a top surface of the bottom substrate, and is electrically connected to the antenna of the top substrate through the circuit of the bottom substrate and the antenna transmission lines.

Since the antenna chip is directly mounted on the bottom substrate, the antenna chip can be electrically connected to a processor through the circuit of the bottom substrate. For example, the bottom substrate can be a printed circuit board (PCB), and the processor can also be mounted on the bottom substrate. Therefore, a plurality of communication lines do not need to be electrically connected between the antenna of the top substrate and the circuit of the bottom substrate. The antenna chip can be directly electrically connected to the processor through the circuit of the bottom substrate.

Further, the antenna chip still needs to be electrically connected to the antenna of the top substrate. Therefore, the antenna transmission lines need to be electrically connected between the antenna of the top substrate and the circuit of the bottom substrate. However, since the antenna chip does not need to communicate with the antenna to execute complicated functions, the antenna transmission lines just need to transmit a simple antenna signal between the antenna and the antenna chip.

Therefore, an amount of the antenna transmission lines can be smaller than an amount of communication lines for communicating the antenna chip and the processor. Moreover, the total size of the antenna packaging structure can be reduced.

DETAILED DESCRIPTION OF THE INVENTION

Figure 1:
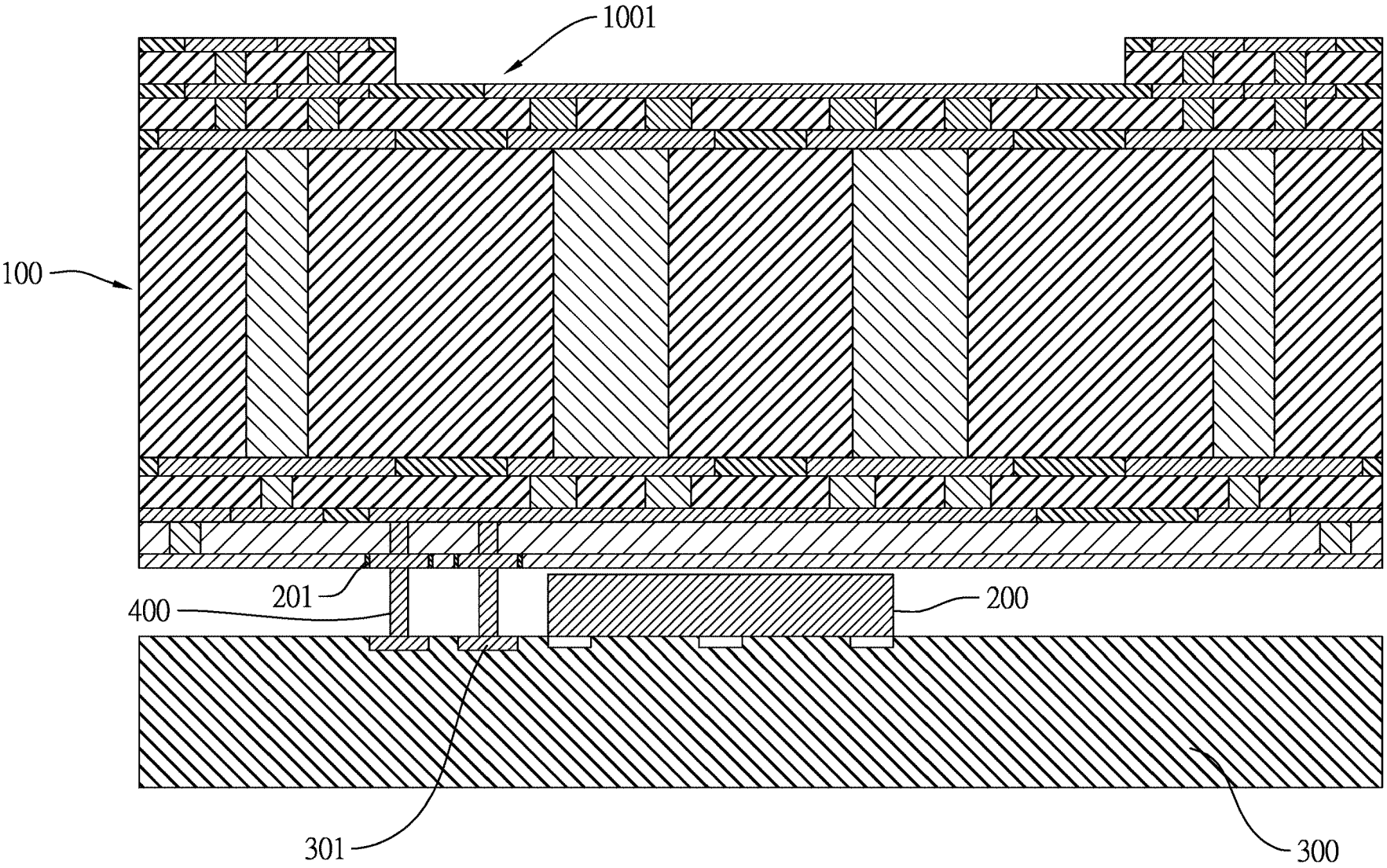
FIG. 1 is a cross sectional view of an embodiment of an antenna packaging structure of the present invention.

With reference to FIG. 1, the present invention relates to an antenna packaging structure. The antenna packaging structure includes a top substrate 100, an antenna chip 200, a bottom substrate 300, and a plurality of antenna transmission lines 400. In an embodiment of the antenna packaging structure, the antenna chip 200 includes an antenna integrated circuit (IC) and an antenna processor. For example, the antenna IC may be an antenna transceiver, such as a Radio Frequency Integrated Circuit (RFIC), and the antenna processor may be a digital processor.

The top substrate 100 includes an antenna 1001. The bottom substrate 300 includes a circuit 301, and is under the top substrate 100.

The antenna chip 200 is mounted on a top surface of the bottom substrate 300, and is electrically connected to the antenna 1001 of the top substrate 100 through the circuit 301 of the bottom substrate 300 and the antenna transmission lines 400.

Since the antenna chip 200 can be directly electrically connected to a processor through the circuit 301 of the bottom substrate 300, a plurality of communication lines do not need to be electrically connected between the antenna 1001 of the top substrate 100 and the circuit 301 of the bottom substrate 300.

Further, the antenna chip 200 still needs to be electrically connected to the antenna 1001 of the top substrate 100. Therefore, the antenna transmission lines 400 need to be electrically connected between the antenna 1001 of the top substrate 100 and the circuit 301 of the bottom substrate 300. However, since the antenna chip 200 does not need to communicate with the antenna 1001 to execute complicated functions, the antenna transmission lines 400 just need to transmit a simple antenna signal between the antenna 1001 and the antenna chip 200.

Therefore, an amount of the antenna transmission lines 400 can be smaller than an amount of communication lines for communicating the antenna chip 200 and the processor. Moreover, the total size of the antenna packaging structure can be reduced. Namely, the antenna packaging structure of the present invention is a total solution of an antenna packaging structure in a very compact size.

Figure 2:
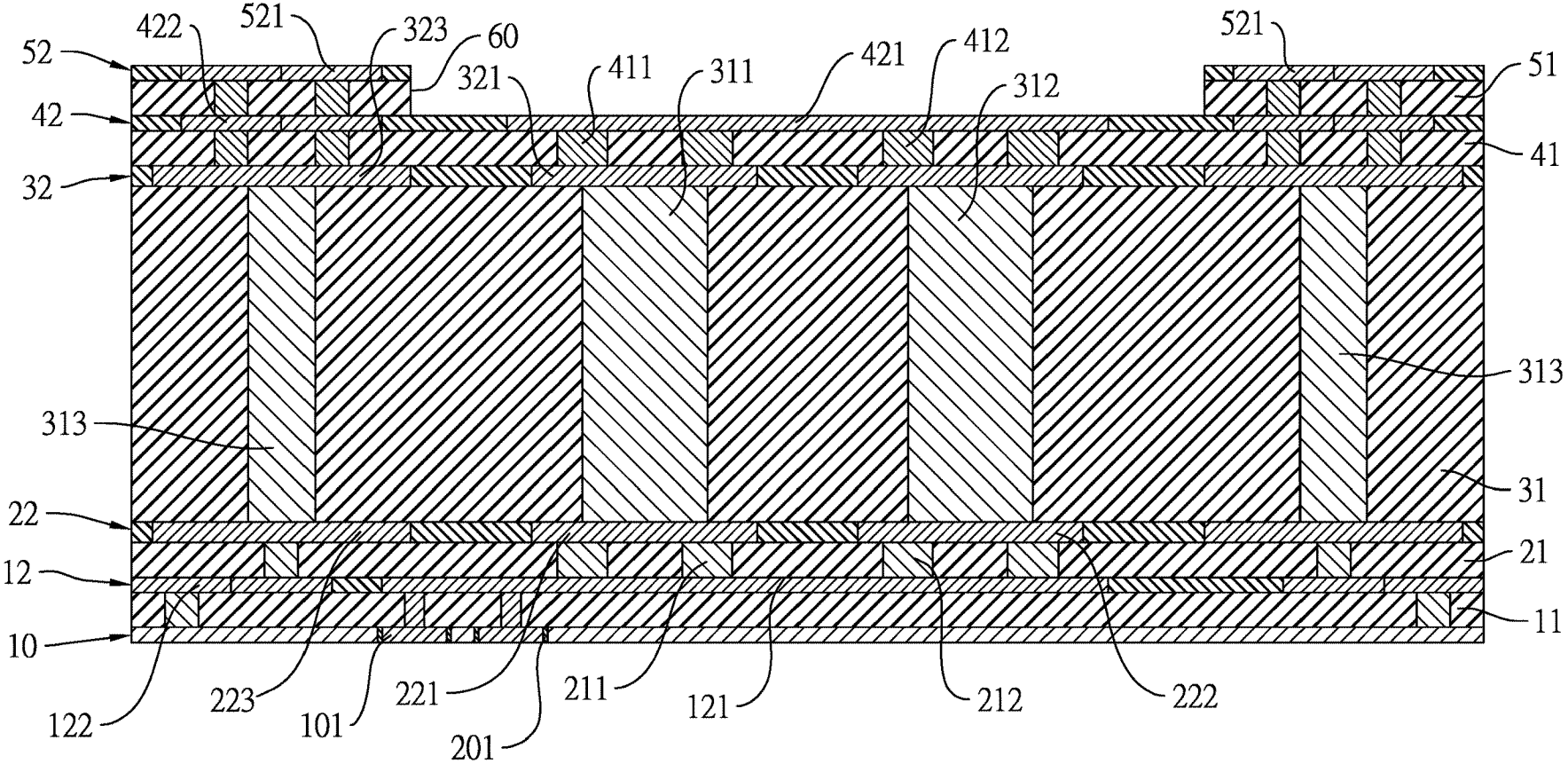
FIG. 2 is a cross sectional view of an embodiment of an antenna of the antenna packaging of the present invention.
Figure 3:
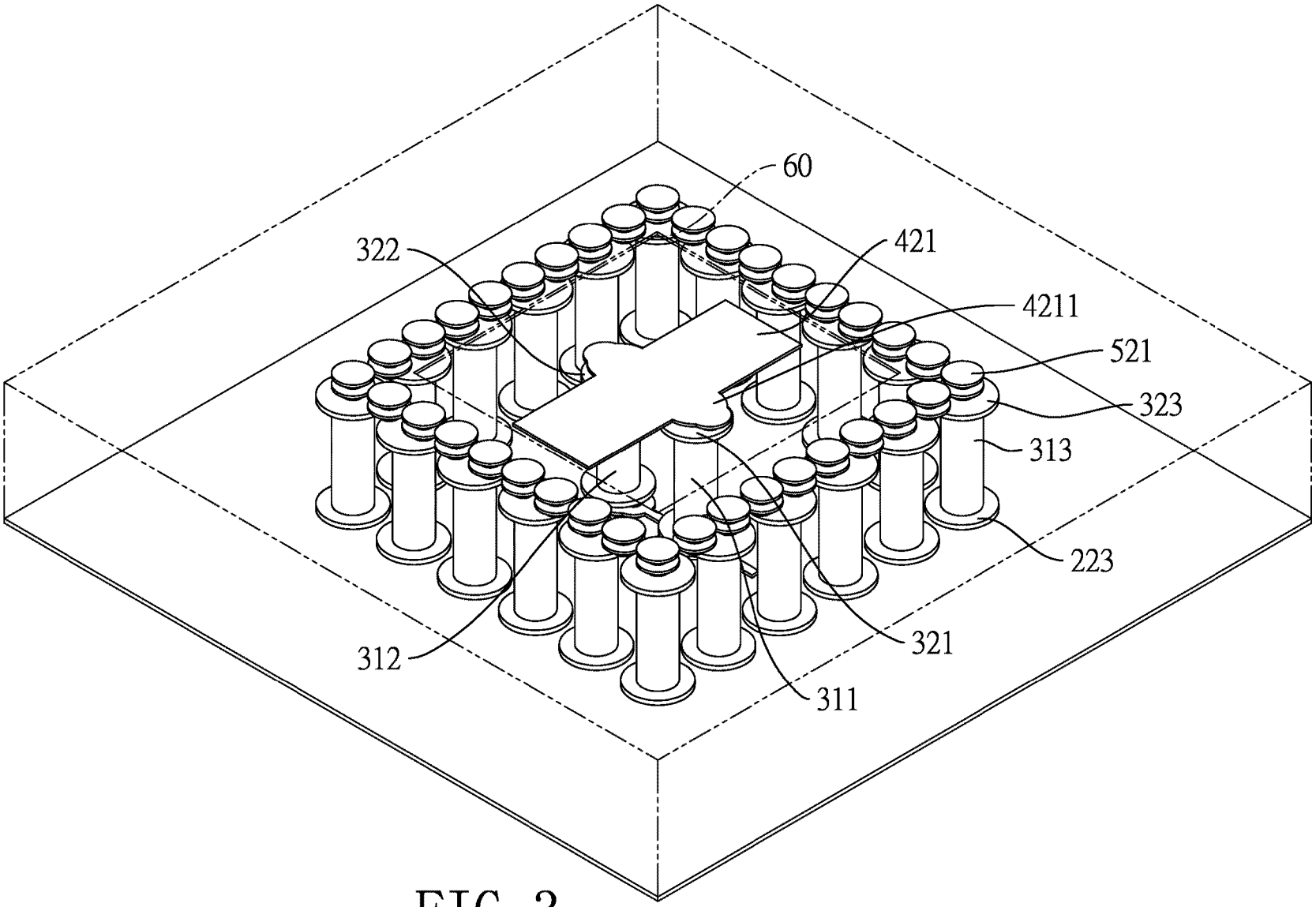
FIG. 3 is a schematic view of the embodiment of the antenna of the present invention.
Figure 4:
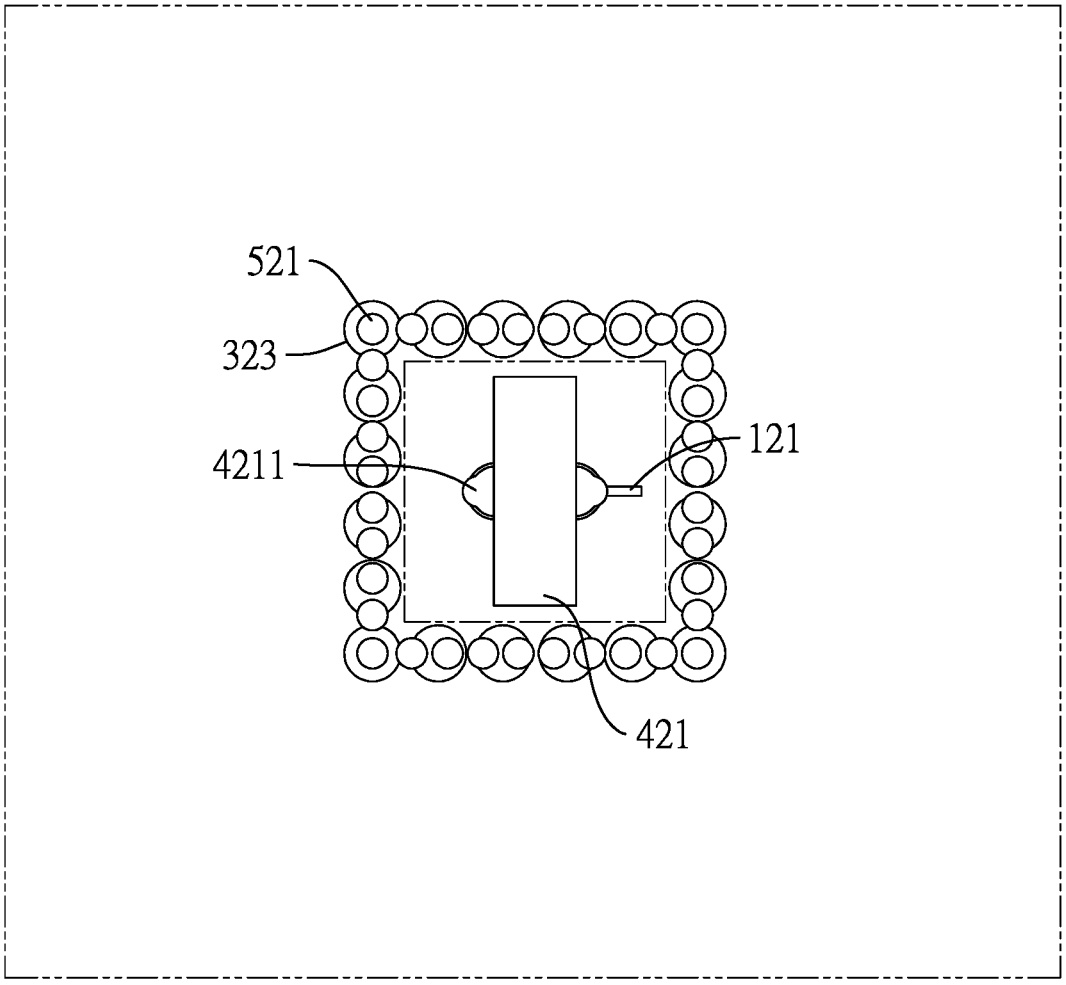
FIG. 4 is a top view of the embodiment of the antenna of the present invention.

Further, with reference to FIGS. 2 to 4, the antenna 1001 includes a grounding layer 10, a first substrate layer 11, a first circuit layer 12, a second substrate layer 21, a second circuit layer 22, a third substrate layer 31, a third circuit layer 32, a fourth substrate layer 41, and a fourth circuit layer 42.

The grounding layer 10 is mounted on a bottom surface of the first substrate layer 11, and includes a grounding circuit 101. The grounding circuit 101 fully covers the bottom surface of the first substrate layer 11. The first circuit layer 12 includes an antenna signal circuit 121 and a plurality of first grounding circuits 122. The first grounding circuits 122 are mounted around the antenna signal circuit 121. The first circuit layer 12 is mounted between a top surface of the first substrate layer 11 and on a bottom surface of the second substrate layer 21.

The second circuit layer 22 includes a first antenna circuit 221, a second antenna circuit 222, and a plurality of second grounding circuits 223. The second grounding circuits 223 are mounted around the first antenna circuit 221 and the second antenna circuit 222.

The third substrate layer 31 includes a first antenna via 311, a second antenna via 312, and a plurality of grounding vias 313. The second circuit layer 22 is mounted between a top surface of the second substrate layer 21 and a bottom surface of the third substrate layer 31. The grounding vias 313 are mounted around the first antenna via 311 and the second antenna via 312. The first antenna circuit 221 and the second antenna circuit 222 are electrically connected to the antenna signal circuit 121 through the second substrate layer 21. The second grounding circuits 223 are electrically connected to the first grounding circuits 122 through the second substrate layer 21.

The third circuit layer 32 includes a third antenna circuit 321, a fourth antenna circuit 322, and a plurality of third grounding circuits 323. The third circuit layer 32 is mounted between a top surface of the third substrate layer 31 and a bottom surface of the fourth substrate layer 41.

Two opposite ends of the first antenna via 311 are respectively electrically connected to the first antenna circuit 221 and the third antenna circuit 321. Two opposite ends of the second antenna via 312 are respectively electrically connected to the second antenna circuit 222 and the fourth antenna circuit 322.

The fourth circuit layer 42 is mounted on a top surface of the fourth substrate layer 41, and includes an antenna radiation circuit 421 and a plurality of fourth grounding circuits 422. The fourth grounding circuits 422 are mounted around the antenna radiation circuit 421. The antenna radiation circuit 421 is electrically connected to the third antenna circuit 321 and the fourth antenna circuit 322 through the fourth substrate layer 41. The fourth grounding circuits 422 are electrically connected to the third grounding circuit 323 through the fourth substrate layer 41.

The grounding circuit, the first grounding circuits, the second grounding circuits, the grounding vias, and the fourth grounding circuits form an isolating wall. The isolating wall includes a cavity to accommodate the antenna signal circuit 121, the first antenna circuit 211, the second antenna circuit 212, the first antenna via 311, the second antenna via 312, and the antenna radiation circuit 421. When the antenna 1001 is mounted in an electronic device, electromagnetic waves generated by integrated circuits (ICs) of the electronic device can be mostly isolated to prevent noise caused by Electromagnetic Interference (EMI).

Further, the antenna 1001 includes a plurality of first through holes 201. The first through holes 201 are formed through the first substrate layer 11 and the grounding layer 10 to expose the antenna signal circuit 121 of the first circuit layer 12.

The antenna transmission lines 400 are electrically connected to the antenna signal circuit 121 of the first circuit layer 12 of the antenna 1001 through the first through holes 201, and the antenna transmission lines 400 can be isolated from the grounding circuit 101 of the grounding layer 10.

Moreover, the antenna 1001 further includes a fifth substrate layer 51 and a fifth circuit layer 52. The fourth circuit layer 42 is mounted between the top surface of the fourth substrate layer 41 and a bottom surface of the fifth substrate layer 51. The fifth circuit layer 52 is mounted on a top surface of the fifth substrate layer 51, and includes a plurality of fifth grounding circuits 521. The fifth grounding circuits 521 are electrically connected to the fourth grounding circuit 422 through the fifth substrate layer 51.

Since the antenna 1001 further includes the fifth substrate layer 51 and the fifth circuit layer 52, the fifth grounding circuits 521 can be higher than the antenna radiation circuit 421. Therefore, an edge of the isolating wall can be higher than the antenna radiation circuit 421 to provide more efficient anti-EMI performance.

Further, a second through hole 60 is formed through the fifth substrate layer 51 and the fifth circuit layer 52, and the antenna radiation circuit 421 can be exposed from the second through hole 60.

The second substrate layer 21 includes two first connecting vias 211 and two second connecting vias 222. The first antenna circuit 221 is electrically connected to the antenna signal circuit 121 through the two first connecting vias 211 of the second substrate layer 21. The second antenna circuit 222 is electrically connected to the antenna signal circuit 121 through the two second connecting vias 212 of the second substrate layer 21.

The fourth substrate layer 41 includes two third connecting vias 411 and two fourth connecting vias 412. The third antenna circuit 321 is electrically connected to the antenna radiation circuit 421 through the two third connecting vias 411 of the fourth substrate layer 41. The fourth antenna circuit 322 is electrically connected to the antenna radiation circuit 421 through the two fourth connecting vias 412 of the fourth substrate layer 41.

With reference to FIG. 2, the antenna radiation circuit 421 of the fourth circuit layer 42 is a rectangular patch, and the rectangular patch includes two connecting parts 4211. The two connecting parts 4211 are each respectively extended from two long sides of the rectangular patch.

One of the two connecting parts 4211 is electrically connected to the third antenna circuit 321 through the two third connecting vias 411 of the fourth substrate layer 41, and the other one of the two connecting parts 4211 is electrically connected to the fourth antenna circuit 322 through the two fourth connecting vias 412 of the fourth substrate layer 41.

Further, the two connecting parts 4211 are each respectively extended from middles of the two long sides of the rectangular patch.

The antenna radiation circuit 421 is the rectangular patch having the two connecting parts 4211 each respectively extended from the middles of the two long sides of the rectangular patch. Therefore, the antenna 1001 has a LC-balanced feeding design for enhancing antenna efficiency and bandwidth.

In conclusion, since the isolating wall includes the cavity to accommodate the antenna signal circuit 121, the first antenna circuit 211, the second antenna circuit 212, the first antenna via 311, the second antenna via 312, and the antenna radiation circuit 421, the antenna 1001 is a cavity backed antenna. Namely, the antenna 1001 has a cavity backed design for gain enhancement.

Moreover, the grounding circuit 101 includes a plurality of connecting holes. The antenna signal circuit 121 is mounted near the bottom of the antenna 1001, and the antenna signal circuit 121 can be electrically connected to an outer printed circuit board (PCB) through the connecting holes for transmitting signals. Therefore, the antenna signal circuit 121 can be electrically connected to the PCB, and can be isolated from the grounding circuit 101. Namely, the antenna 1001 also has a bottom-fed design for size reduction.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An antenna packaging structure, comprising:

a top substrate, comprising an antenna;

an antenna chip;

a bottom substrate, comprising a circuit, and being under the top substrate;

a plurality of antenna transmission lines, electrically connected between the antenna of the top substrate and the circuit of the bottom substrate;

wherein the antenna chip is mounted on a top surface of the bottom substrate, and is electrically connected to the antenna of the top substrate through the circuit of the bottom substrate and the antenna transmission lines;

wherein the antenna comprises:

a first substrate layer;

a grounding layer, mounted on a bottom surface of the first substrate layer, and comprising a grounding circuit; wherein the grounding circuit fully covers the bottom surface of the first substrate layer;

a first circuit layer, comprising an antenna signal circuit and a plurality of first grounding circuits; wherein the first grounding circuits are mounted around the antenna signal circuit;

a second substrate layer; wherein the first circuit layer is mounted between a top surface of the first substrate layer and on a bottom surface of the second substrate layer;

a second circuit layer, comprising a first antenna circuit, a second antenna circuit, and a plurality of second grounding circuits; wherein the second grounding circuits are mounted around the first antenna circuit and the second antenna circuit;

a third substrate layer, comprising a first antenna via, a second antenna via, and a plurality of grounding vias;

wherein the second circuit layer is mounted between a top surface of the second substrate layer and a bottom surface of the third substrate layer;

wherein the grounding vias are mounted around the first antenna via and the second antenna via;

wherein the first antenna circuit and the second antenna circuit are electrically connected to the antenna signal circuit through the second substrate layer;

wherein the second grounding circuits are electrically connected to the first grounding circuits through the second substrate layer;

a third circuit layer, comprising a third antenna circuit, a fourth antenna circuit, and a plurality of third grounding circuits;

a fourth substrate layer; wherein the third circuit layer is mounted between a top surface of the third substrate layer and a bottom surface of the fourth substrate layer, wherein two opposite ends of the first antenna via are respectively electrically connected to the first antenna circuit and the third antenna circuit;

wherein two opposite ends of the second antenna via are respectively electrically connected to the second antenna circuit and the fourth antenna circuit, a fourth circuit layer, mounted on a top surface of the fourth substrate layer, and comprising an antenna radiation circuit and a plurality of fourth grounding circuits;

wherein the fourth grounding circuits are mounted around the antenna radiation circuit;

wherein the antenna radiation circuit is electrically connected to the third antenna circuit and the fourth antenna circuit through the fourth substrate layer;

wherein the fourth grounding circuits are electrically connected to the third grounding circuits through the fourth substrate layer.

2. The antenna packaging structure as claimed in claim 1, wherein the antenna further comprises:

a plurality of first through holes, formed through the first substrate layer and the grounding layer to expose the antenna signal circuit of the first circuit layer;

wherein the antenna transmission lines are electrically connected to the antenna signal circuit of the first circuit layer of the antenna through the first through holes, and the antenna transmission lines are isolated from the grounding circuit of the grounding layer.

3. The antenna packaging structure as claimed in claim 1, wherein the antenna further comprises:

a fifth substrate layer; wherein the fourth circuit layer is mounted between the top surface of the fourth substrate layer and a bottom surface of the fifth substrate layer;

a fifth circuit layer, mounted on a top surface of the fifth substrate layer, and comprising a plurality of fifth grounding circuits;

wherein the fifth grounding circuits are electrically connected to the fourth grounding circuits through the fifth substrate layer.

4. The antenna packaging structure as claimed in claim 1, wherein the second substrate layer of the antenna comprises:

two first connecting vias; wherein the first antenna circuit is electrically connected to the antenna signal circuit through the two first connecting vias of the second substrate layer;

two second connecting vias; wherein the second antenna circuit is electrically connected to the antenna signal circuit through the two second connecting vias of the second substrate layer.

5. The antenna packaging structure as claimed in claim 1, wherein the fourth substrate layer of the antenna comprises:

two third connecting vias; wherein the third antenna circuit is electrically connected to the antenna radiation circuit through the two third connecting vias of the fourth substrate layer;

two fourth connecting vias; wherein the fourth antenna circuit is electrically connected to the antenna radiation circuit through the two fourth connecting vias of the fourth substrate layer.

6. The antenna packaging structure as claimed in claim 3, wherein the fourth substrate layer of the antenna comprises:

two third connecting vias; wherein the third antenna circuit is electrically connected to the antenna radiation circuit through the two third connecting vias of the fourth substrate layer;

two fourth connecting vias; wherein the fourth antenna circuit is electrically connected to the antenna radiation circuit through the two fourth connecting vias of the fourth substrate layer.

7. The antenna packaging structure as claimed in claim 5, wherein the antenna further comprises a second through hole;

wherein the second through hole is formed through the fifth substrate layer and the fifth circuit layer to expose the antenna radiation circuit.

8. The antenna packaging structure as claimed in claim 7, wherein the antenna radiation circuit of the fourth circuit layer of the antenna is a rectangular patch, and the rectangular patch comprises two connecting parts;

wherein the two connecting parts are each respectively extended from two long sides of the rectangular patch;

wherein one of the two connecting parts is electrically connected to the third antenna circuit through the two third connecting vias of the fourth substrate layer, and the other one of the two connecting parts is electrically connected to the fourth antenna circuit through the two fourth connecting vias of the fourth substrate layer.

9. The antenna packaging structure as claimed in claim 8, wherein the two connecting parts are each respectively extended from middles of the two long sides of the rectangular patch.

* * * * *